US005685239A

United States Patent [19]

Bentley

[11] Patent Number: 5,685,239

[45] Date of Patent: Nov. 11, 1997

[54] WALL SAFE ASSEMBLY

[76] Inventor: James K. Bentley, 2489 Starling Dr., Paso Robles, Calif. 93446

[21] Appl. No.: 700,145

[22] Filed: Aug. 20, 1996

[51] Int. Cl.[6] ..... E05G 1/00

[52] U.S. Cl. ..... 109/50; 109/52; 70/58; 70/63

[58] Field of Search ..... 70/57, 58, 63, 70/232; 109/50–57

[56] References Cited

U.S. PATENT DOCUMENTS

| | | | |
|---|---|---|---|
| 1,901,904 | 3/1933 | Ehrlich | 109/51 X |
| 2,010,877 | 8/1935 | Morell | 109/51 |
| 3,146,739 | 9/1964 | Furman | 109/52 |
| 4,006,614 | 2/1977 | Decker | 70/63 |
| 4,043,279 | 8/1977 | Padgett | 109/50 |
| 4,909,052 | 3/1990 | Hutwohl | 109/50 X |
| 4,951,577 | 8/1990 | Bentley | 70/63 X |
| 4,987,836 | 1/1991 | Owen | 70/63 X |
| 5,129,536 | 7/1992 | Robinson | 70/63 X |
| 5,235,920 | 8/1993 | Hector | 70/63 X |
| 5,325,686 | 7/1994 | Bentley | 70/58 |

FOREIGN PATENT DOCUMENTS

| | | | |
|---|---|---|---|
| 560574 | 12/1930 | Germany | 109/50 |

*Primary Examiner*—Suzanne Dino

[57] ABSTRACT

A wall safe assembly that is designed to be secured to a vertically oriented stud such as that positioned behind a sheet of drywall or paneling in the structure of a building. Generally the wall safe assembly would be mounted in a closet in one of its corners. The major components of the wall safe assembly are the wall safe housing and the mounting block. The circular top and bottom walls of the wall safe have a T-shaped tongue member extending laterally from their periphery. The front wall of the mounting block has vertically spaced T-shaped apertures with cavities therebehind for removably receiving the T-shaped tongue members. A lock assembly is removably received in the cavity behind the upper T-shaped aperture for preventing removal of the wall safe housing.

5 Claims, 2 Drawing Sheets

WALL SAFE ASSEMBLY

BACKGROUND OF THE INVENTION

The invention relates to a safe for storing personal valuables therein and more specifically to a safe that can be secured to the external surface of a wall in a closet or other structural walls.

One of the most serious problems the public at large faces are break-ins and the burglaries resulting therefrom. Some of the items most commonly taken are cash and jewelry. A considerable number of these burglars are not professional criminals, just juveniles and persons stealing to support a drug habit.

Another problem area for burglaries is in hotel and motel rooms. The burglaries involving these premises are often committed by professional thieves and they execute the crime in a short period of time.

It is an object of the invention to provide a novel wall safe assembly that can be secured to the corner studs in a closet so that it can't be ripped off the wall.

It is also an object of the invention to provide a novel wall safe assembly mounted in the closet that can be utilized by hotel or motel guests.

It is another object of the invention to provide a novel wall safe assembly that allows the bottom end of the wall safe housing to be captured while it is tipped outwardly to a position that allows the top wall of the wall safe housing to be removed for gaining access to its interior.

It is another object of the invention to provide a novel wall safe assembly that is economical to manufacture and market.

It is an additional object of the invention to provide a novel wall safe assembly that can be easily installed, while still being designed so that it cannot be ripped off the wall.

It is a further object of the invention to provide a novel wall safe assembly that would require the wall to be destroyed before the wall safe assembly could be removed therefrom.

SUMMARY OF THE INVENTION

Applicant's novel wall safe assembly has been designed as an economical safe that can be installed in a person's residence in a closet. Its unique structure lends itself to being utilized by hotels and motels in a closet in the rooms.

The wall safe housing has a cylindrical tubular shape and it would be preferably made of steel. Its top and bottom walls would be preferably threadably secured by screwing them into internal threads at the top and bottom of the cylinder housing. Integrally formed with the top and bottom walls are T-shaped tongue members. These are matingly received in the respective upper and lower T-shaped apertures in the front wall of the mounting block. Interiorly of these apertures are cavities that will receive the transverse member of the respective T-shaped tongue members. The height of the vertical slot of the lower T-shaped aperture is greater than that of the vertical slot of the upper T-shaped aperture. This allows the bottom T-shaped tongue member to remain captured when the wall safe housing is lifted slightly and its top end pivoted outwardly to the person. Thus, with the wall safe housing still being supported, the person can remove the top wall of the wall safe housing and remove or insert valuables.

The lock assembly is sized so that it is slightly smaller than the transverse slot of the upper T-shaped aperture. A vertical tang recess at the top of its cavity that captures the tang of the lock when the key is rotated. Removal of the key prevents the wall safe housing from being removed unless someone can destroy the lock and get the lock tang removed from the vertical tang recess.

The wall safe housing has a cylindrical chamber therein which removably receives a tray assembly for keeping different valuables and jewelry therein. The tray assembly consists of a vertically extending tubular structure having a plurality of trays secured thereon at predetermined vertical spaced positions.

DESCRIPTION OF THE PREFERRED EMBODIMENT

Figure 1:
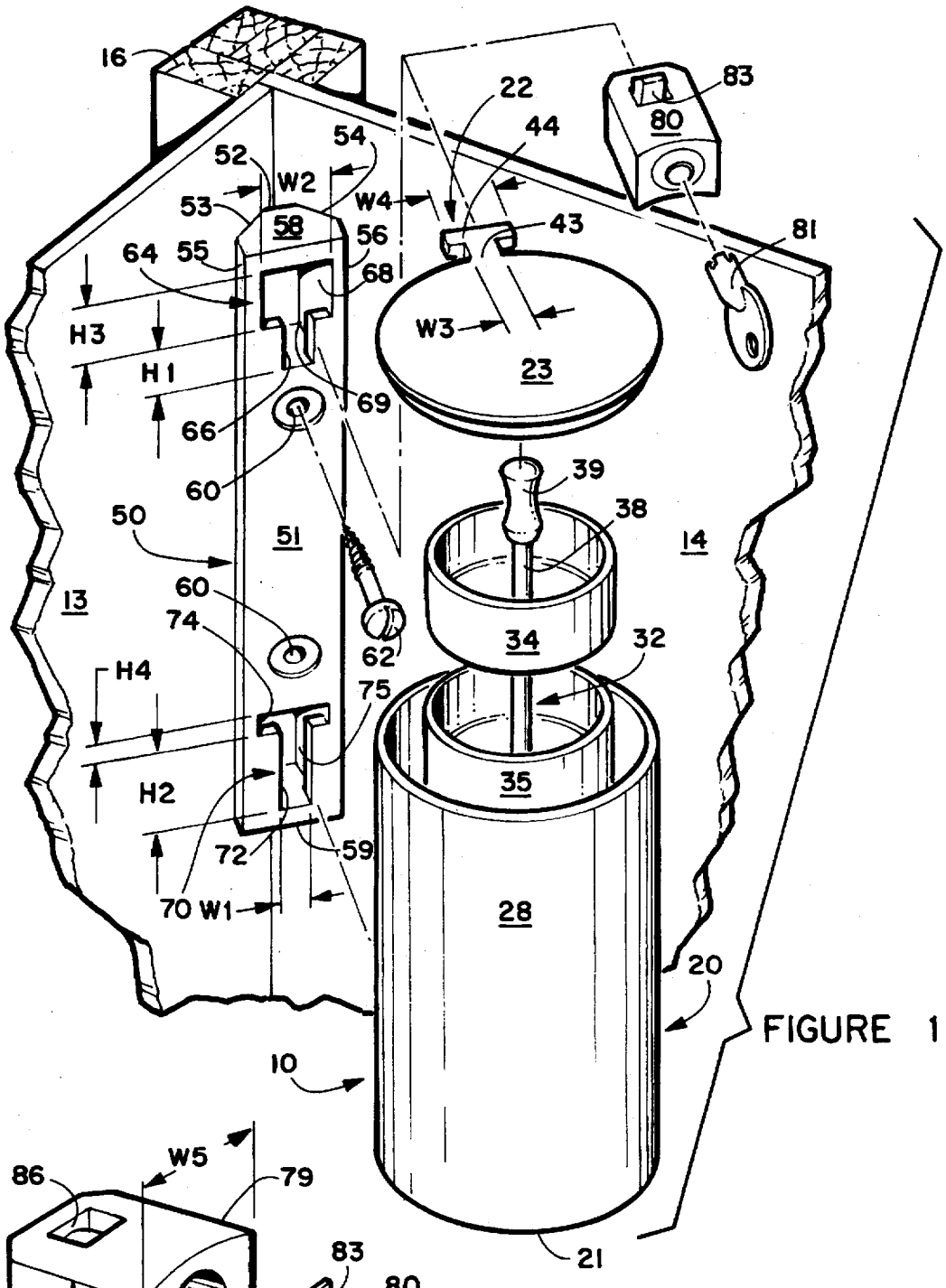
FIG. 1 is a front perspective view showing the wall safe assembly in exploded view and also the manner in which it is attached to the corner stud of a closet.
Figure 2:
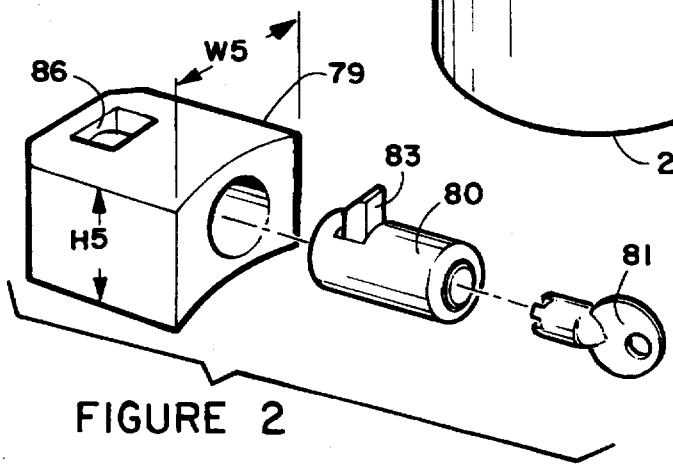
FIG. 2 is an exploded front perspective view of the lock assembly.
Figure 3:
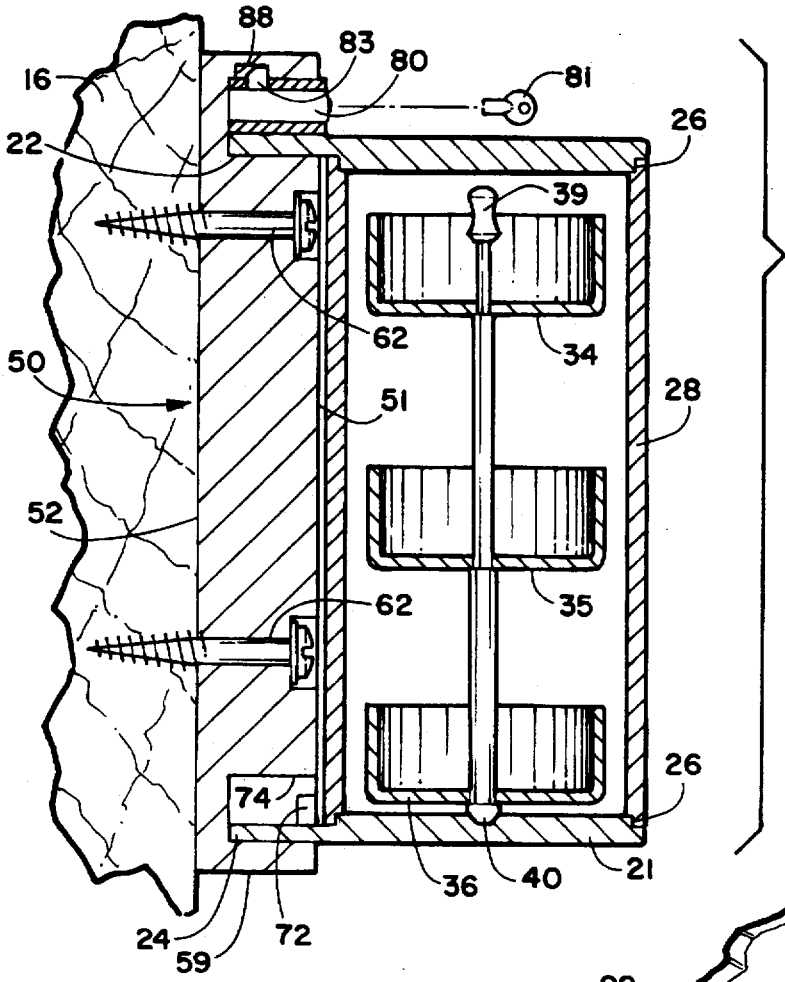
FIG. 3 is a cross sectional view illustrating the wall safe assembly in its installed position in the corner of a closet.

Applicant's novel wall safe assembly will now be described by referring to FIGS. 1–4 of the drawings. The wall safe assembly is generally designated numeral 10.

Wall safe assembly 10 would generally be mounted in a closet having walls 13 and 14 made of sheets of dry wall or paneling. Positioned behind walls 13 and 14, at their corner are studs 16. The wall safe housing is generally designated numeral 20 and it has a bottom wall 21 and a cover or a top wall 23. T-shaped tongue members 22 and 24 extend laterally from the periphery of the respective top and bottom wall members. Each has a threaded interior surface that mates with internal threads 26 at the respective top and bottom ends of cylindrical tube 28. A tray assembly 32 has a plurality of trays 34,35 and 36 that are mounted at spaced vertical positions on rod assembly 38. Top end cap 39 is located on the top end of rod assembly 38 and a bottom end cap 40 is located on the bottom end thereof. Each of the T-shaped tongue members 22 and 24 have a neck portion 43 and a transverse member 44. Neck portion 43 has a width W3 and transverse member 44 has a width W4.

Mounting block 50 is a solid member formed of metal having a front wall 51, a center rear wall 52 a left rear wall 53, a right rear wall 54, a left side wall 55 and a right side wall 56. It also has a top wall 58 and a bottom wall 59. Vertically spaced bore holes 60 are countersunk in front wall 51 and they receive lag bolts 62 for securing the mounting block 50 to the corner studs 16.

An upper T-shaped aperture 64 is formed in front wall 51. It has an elongated vertical slot 66 having a width W1 and a height H1. Transverse slot 68 has a height H3 and a width W2. A cavity 69 is formed behind upper T-shaped aperture 64 and it functions to capture the T-shaped tongue member 22.

Lower T-shaped aperture 70 has an elongated vertical slot 72 having a height H2 and a width W1. H2 is greater than H1 so that the wall safe housing 20 can be lifted slightly in order to release T-shaped tongue member 22 which will then allow the wall safe housing 20 to be pivoted forwardly while the lower T-shaped tongue member 24 remains captured. While thus captured, top wall 23 can be removed and valuables either be removed or stored in cylindrical tube 28. Transverse slot 74 has a width W2 and a height H4. H4 would only be slightly larger than the height of T-shaped tongue member 24. Lower cavity 75 is formed behind lower T-shaped aperture 70.

Lock assembly 78 is formed of a lock block 79, a lock 80 and a key 81 having a cylindrical shank. Lock block 79 has a width W5 and a height H5. W5 is slightly smaller than W2 and H5 is slightly less than H3 so that lock box 79 can be inserted into upper cavity 79 when T-shaped tongue member 22 is captured therein. Lock 80 has a spring loaded tang 83 that is automatically depressed when lock 80 is inserted into bore 85. As it travels forwardly tang 83 will pop upwardly through aperture 86 and prevent removal of lock 80 from lock box 79. A vertically extending tang recess 88 is formed in the top surface of upper cavity 69 and it receives tang 83 when key 81 is turned causing it to travel upwardly into recess 88. Once key 81 has been removed it is impossible to remove the wall safe housing without destroying lock 80.

Figure 5:
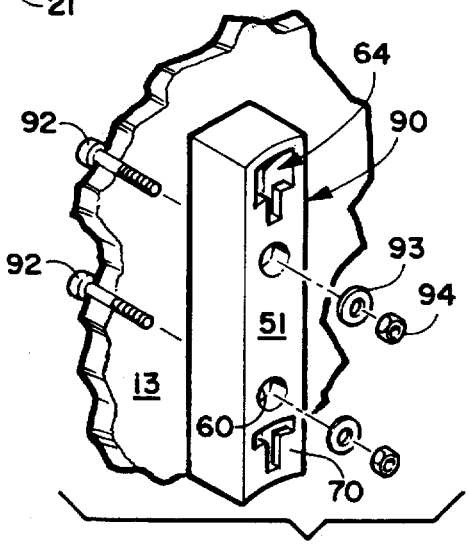
FIG. 5 is a front perspective view of an alternative mounting block and the manner in which it is secured to a wall.
Figure 4:
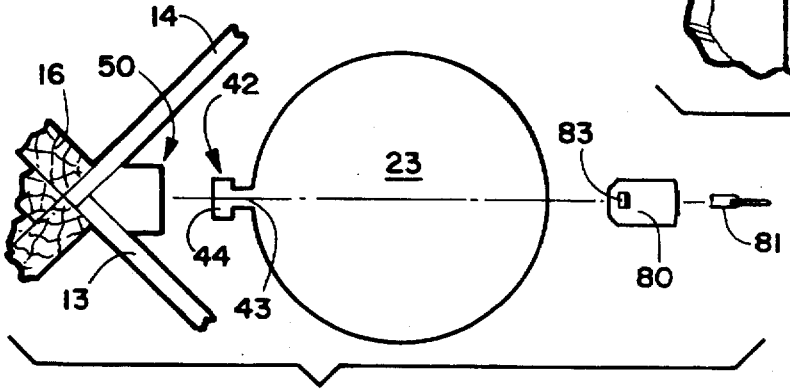
FIG. 4 is an exploded top plan view illustrating the manner in which the safe housing is inserted into the mounting block.

An alternative mounting block 90 is illustrated in FIG. 5. It has a rectangular horizontal cross section and it would be mounted to a wall 13 by bolts 92, washers 93 and nuts 94. The structure of the wall safe housing 20 would be exactly the same as that described earlier.

What is claimed is:

1. A wall safe assembly comprising:

an upright oriented elongated mounting block having a top wall, a bottom wall, a front wall, and a rear wall;

mounting means for removably securing said mounting block to a supporting wall;

an upright oriented wall safe housing comprising an elongated cylindrical tube having a top end and a bottom end; a circular top wall having a periphery and having a first tongue member extending laterally from said periphery; means for removably securing said top wall to said cylindrical tube; a circular bottom wall having a periphery and having a second tongue member extending laterally from said periphery; means for securing said bottom wall to said cylindrical tube;

first mounting means for removably securing said first tongue member to the front wall of said mounting block;

second mounting means for removably securing said second tongue member to the front wall of said mounting block;

said first and second tongue members have a T-shaped configuration formed by a neck portion having a width W3 and a transverse member having a width W4;

said first mounting means comprises an upper vertically oriented T-shaped aperture formed in the front wall of said mounting block, said upper T-shaped aperture having an elongated vertical slot and a transverse slot; said vertical slot having a width W1 and a height H1 and W1 is greater than W3 so that the neck portion of said first tongue member will pass downwardly therein; the transverse slot of said upper T-shaped aperture has a width W2 and a height H3 and W2 is greater than W4 so that the transverse member of said first tongue member will pass therethrough; an upper cavity is formed in said mounting block behind said upper T-shaped aperture for removably receiving the transverse member of said first tongue member;

said second mounting means comprises a lower vertically oriented T-shaped aperture formed in the front wall of said mounting block, said lower T-shaped aperture having an elongated vertical slot and a transverse slot; said vertical slot having a width W1 and a height H2 and W1 is greater than W3 so that the neck portion of said second tongue member will pass downwardly therein; the transverse slot of said lower T-shaped aperture has a width W2 and a height H4 and W2 is greater than W4 so that the transverse member of said second tongue member will pass therethrough; a lower cavity is formed in said mounting block behind said lower T-shaped aperture for removably receiving the transverse member of said second tongue member; and H2 is greater than H1 so that said first tongue member can be removed from said upper T-shaped aperture while said second tongue member remains captured in said lower T-shaped aperture thus allowing the top end of said cylindrical tube to be pivoted outwardly away from said mounting block and also allowing said circular top wall to be removed in order to gain access to the interior of said wall safe housing;

a lock assembly; and means for mounting said lock assembly in the front wall of said mounting block for preventing removal of said first and second tongue members from said mounting block.

2. A wall safe assembly as recited in claim 1 wherein said mounting means comprises a pair of vertically spaced bore holes in said mounting block that extend from said front wall to said rear wall and a lag bolt for each of said bore holes.

3. A wall safe assembly as recited in claim 1 wherein said mounting block has a substantially wedge-shaped horizontal cross section.

4. A wall safe assembly as recited in claim 1 wherein said mounting block has a substantially rectangular shaped cross section.

5. A wall safe assembly as recited in claim 1 wherein said lock assembly comprises a lock block and a circular key lock that is removably mounted therein; said lock block having a height H5 and a width W5 and H3 is greater than H5 and W2 is greater than W5 so that said lock assembly can be inserted in said upper cavity.

* * * * *